US005487297A

United States Patent [19]

Ryan et al.

[11] Patent Number: 5,487,297

[45] Date of Patent: Jan. 30, 1996

[54] CRIMPING TOOL HAVING MECHANISM FOR SELECTIVELY BIASING CRIMPING DIES TO OPEN OR CLOSED POSITION

[75] Inventors: Dale Ryan; Eric Kootte, both of Harrisburg, Pa.

[73] Assignee: The Whitaker Corporation, Wilmington, Del.

[21] Appl. No.: 373,349

[22] Filed: Jan. 17, 1995

[51] Int. Cl.[6] ..... B21J 9/18

[52] U.S. Cl. ..... 72/450; 72/452; 72/453.16; 29/243.56; 29/753

[58] Field of Search ..... 72/450, 462, 410, 72/453.16, 453.18; 29/243.56, 751, 753

[56] References Cited

U.S. PATENT DOCUMENTS

| | | | |
|---|---|---|---|
| 2,647,814 | 8/1953 | Chilton | 1/187 |
| 2,766,631 | 10/1956 | Van Sittert | 74/110 |
| 2,962,074 | 11/1960 | Dupre et al. | 153/1 |
| 4,109,504 | 8/1978 | Rommel | 72/407 |
| 4,932,237 | 6/1990 | Hatfield | 72/452 |
| 5,309,751 | 5/1994 | Ryan | 72/450 |

FOREIGN PATENT DOCUMENTS

| | | | |
|---|---|---|---|
| 694831 | 9/1964 | Canada | 29/84.101 |

*Primary Examiner*—David Jones
*Attorney, Agent, or Firm*—Robert J. Kapalka

[57] ABSTRACT

A crimping tool has a movable die attached to a reciprocable slide member for movement toward and away from a fixed die. A pair of rollers are journaled for rotation in pivotable links carried by the slide member. An actuating mechanism includes a wedge which is movable between the pair of rollers to drive the rollers apart and into engagement with a pair of ramps, thereby moving the slide member and the movable die toward the fixed die. A biasing mechanism is selectively operable to bias the slide member and the movable die either toward or away from the fixed die with a relatively small force during times when the wedge is withdrawn from between the rollers.

11 Claims, 5 Drawing Sheets

CRIMPING TOOL HAVING MECHANISM FOR SELECTIVELY BIASING CRIMPING DIES TO OPEN OR CLOSED POSITION

FIELD OF THE INVENTION

The invention relates to a crimping tool having a mechanism for selectively biasing the crimping dies to either an open or a closed position with a relatively small force during intervals between crimping operations.

BACKGROUND OF THE INVENTION

U.S. Pat. No. 5,309,751 discloses a portable crimping tool of the straight action type wherein a crimping die is movable along an axis into crimping engagement with a mating fixed die. In this crimping tool the movable die is carried on a slide member which has a pair of links pivotally attached thereto. A pair of first rollers are attached at respective remote ends of the links, and a pair of second rollers are attached to the tool frame. A linear actuator drives a wedge between the pair of first rollers and urges the first rollers into rolling engagement with the second rollers, thereby linearly moving the slide member and the movable die toward the fixed die. The wedge, the pair of first rollers and the pair of second rollers cooperate to provide a varying mechanical advantage over different portions of movement of the slide member and the movable die.

In this tool the movable die is normally biased open from the fixed die by springs so that a crimped terminal can be easily removed from between the dies after a crimping cycle, and a new terminal inserted. A problem arises in preparing to crimp the new terminal which is initially disposed loosely on a conductor and which must be properly oriented between the dies. It is difficult for an operator to hold the terminal and conductor in their proper orientation between the dies and to simultaneously operate the tool without the terminal and/or conductor shifting or being dislodged from between the dies. There is a need for a mechanism which would alleviate the problem of holding a terminal and conductor in proper orientation between dies prior to crimping. Further, there is a need for a mechanism which would enable the dies to be held selectively open or closed between crimping operations.

SUMMARY OF THE INVENTION

It is an object of the invention to facilitate crimping of a workpiece in a crimping tool.

It is another object of the invention to assist stabilization of a workpiece in a crimping tool prior to a crimping operation.

It is further object of the invention to enable selective positioning of dies in a crimping tool.

These and other objects are accomplished by a crimping tool comprising a frame and a mating pair of crimping dies, one of which is attached to the frame, the other of which is attached to a slide member coupled to the frame and arranged to reciprocate for effecting movement of the other die along a die axis toward and away from the one die. A pair of links each have one end pivotally attached to and carried by the slide member. A pair of link rollers are each journaled for rotation at an end of a respective one of the links opposite to the pivotal attachment thereof, the link rollers having mutually parallel axes of rotation. A pair of ramps are attached to the frame on respective opposite sides of the link rollers and arranged to be engaged by the link rollers in rolling motion thereon. An actuator is attached to the frame and operable to move a wedge between the link rollers along a wedge axis parallel to the die axis. The wedge is arranged to engage the link rollers during movement of the wedge in one direction such that the link rollers roll on opposite sides of the wedge and are urged into rolling engagement with the ramps, thereby moving the slide member such that the other die is moved toward the one die for effecting crimping of the workpiece. The tool further includes resilient means for biasing apart the links with a relatively small force such that the link rollers are urged into rolling engagement with respective ones of the ramps when the wedge is in a disengaged position from the link rollers, and a means for retracting the slide member such that the other die is selectively movable away from the one die when the wedge is in the disengaged position. The tool has the advantage that the means for retracting enables the other die to be separated from the one die against the biasing force of the resilient means to permit the workpiece to be introduced between the dies, and upon release of the means for retracting, the resilient means urges the other die toward the one die, thereby securing the workpiece between the dies.

BRIEF DESCRIPTION OF THE DRAWINGS

The invention will now be described by way of example with reference to the accompanying drawings in which like elements in different figures thereof are identified by the same reference numeral and wherein.

DETAILED DESCRIPTION OF THE PREFERRED EMBODIMENT

Figure 1:
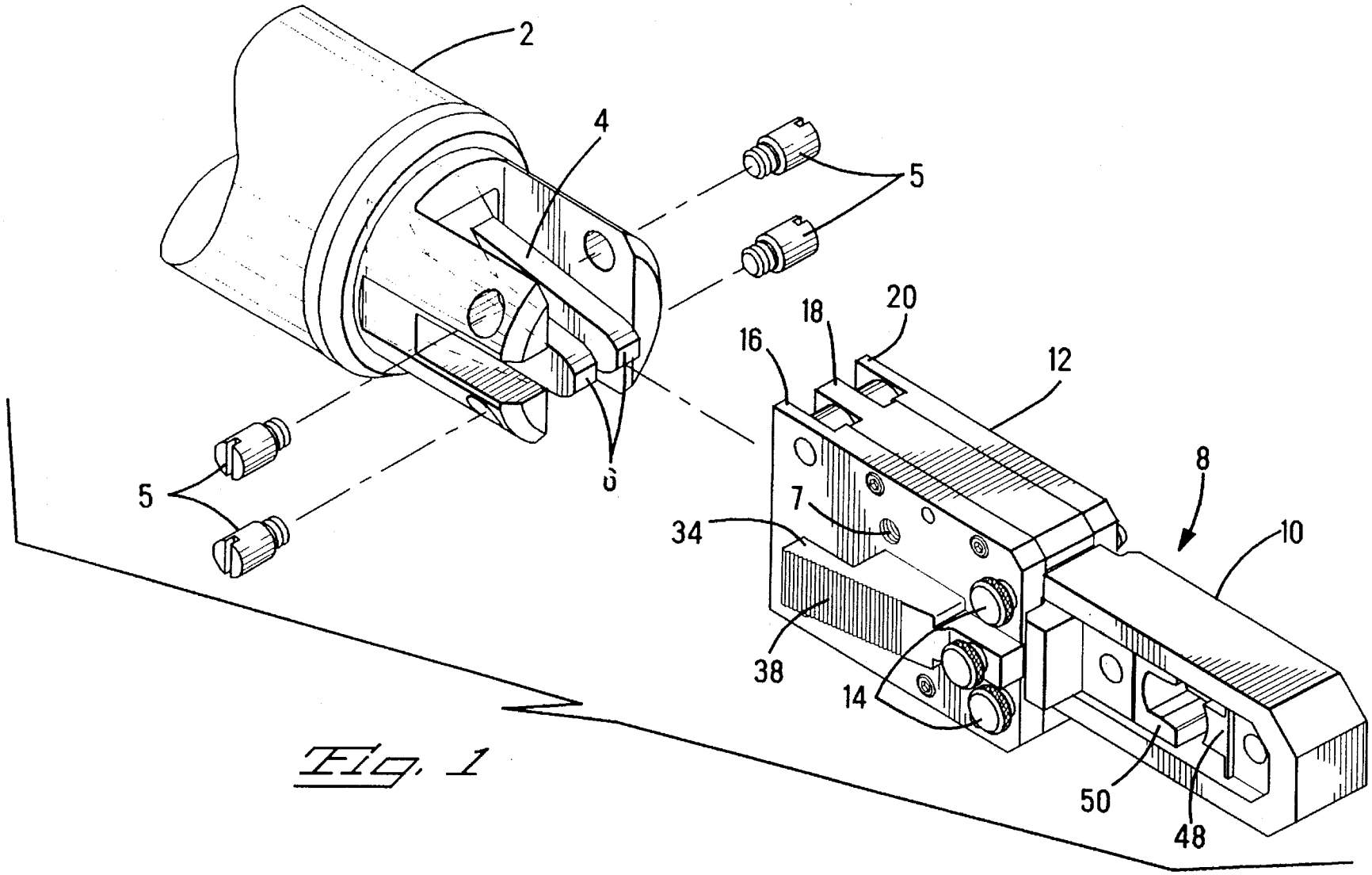
FIG. 1 is a partially exploded isometric view of a crimping tool according to the invention.

With reference to FIG. 1, a tool for crimping a workpiece includes a tool body 2 which houses a linear actuator such as a pneumatic or hydraulic cylinder operable to linearly move a wedge 4 which in the present embodiment comprises a pair of integrally formed wedge elements 6, although a single wedge element may be used. The tool further includes a crimping head 8 which is removably attached to the tool body 2 by threaded fasteners 5 engageable in holes 7, only one of the holes being shown. The crimping head 8 includes a separable die holder 10 and roller housing 12 which are secured together by fasteners 14. The die holder 10 houses a mating pair of crimping dies 48 and 50 for crimping a wire terminal or other workpiece therebetween. The roller housing 12 includes a front housing 16 and a rear housing 20 which are separated by a pair of center housings 18, one center housing on each side of the crimping head as more clearly shown in the cross-sectional view of FIG. 4.

Figure 4:
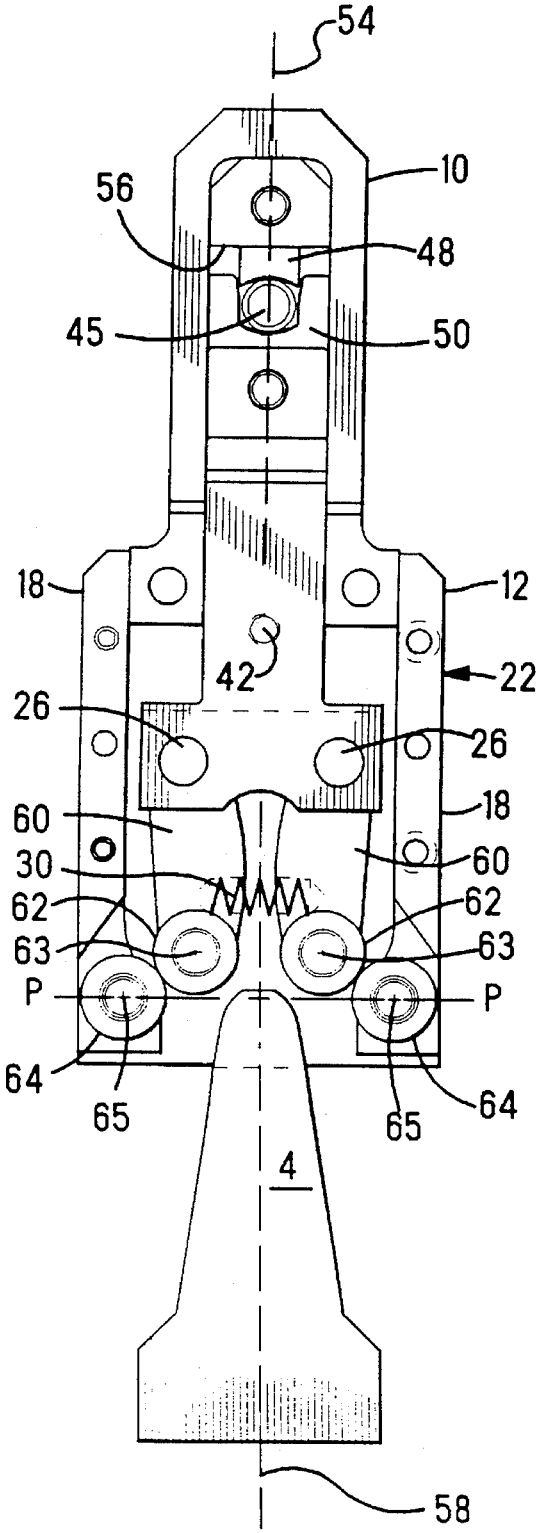
FIG. 4 is a cross-sectional view of the crimping head with a terminal captured in position prior to being crimped.
Figure 5:
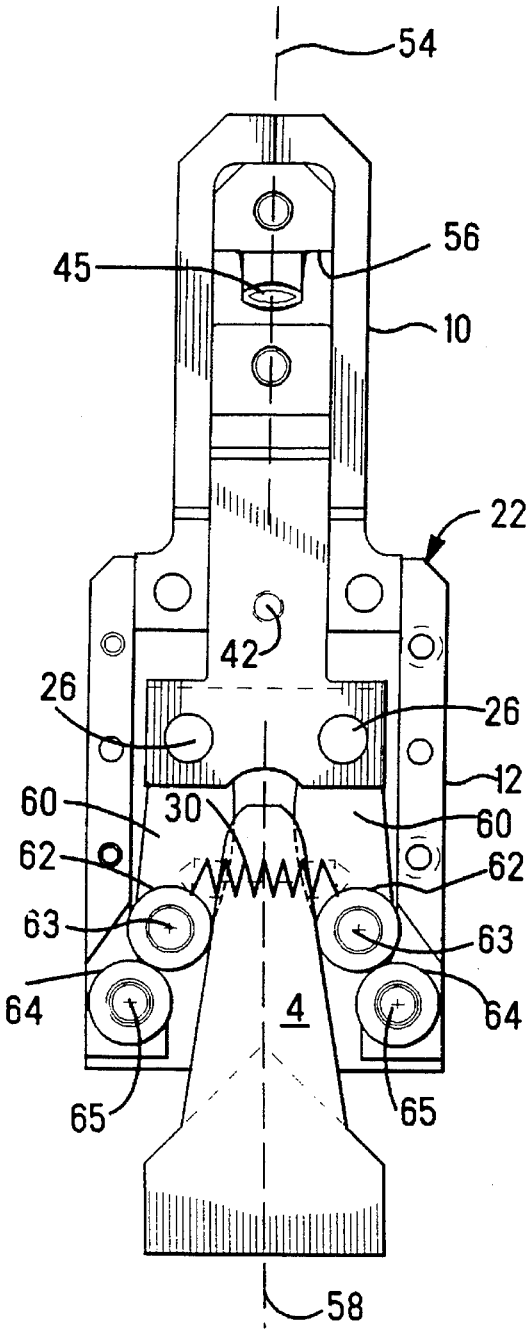
FIG. 5 is a cross-sectional view of the crimping head having dies closed after a crimping stroke.

With reference to FIGS. 4 and 5, the die holder 10 and the roller housing 12 form a frame 22 for the crimping head. The one die 48 is attached to the frame 22 within the die holder 10, while the other die 50 is attached to a slide member 40 which is slidably guided within the frame for reciprocation along a die axis 54. A pair of links 60 each have one end pivotally attached on a pin 26 to the slide member 40. A pair of link rollers 62 are each journaled for rotation at an end of a respective one of the links 60 opposite to the pivotally attached end thereof. The link rollers 62 have mutually parallel axes of rotation 63. A pair of ramps, which in the preferred embodiment comprise ramp rollers 64, are attached to the frame on respective opposite sides of the link rollers 62. Each of the ramp rollers 64 is journaled for rotation on an axis 65, the axes 65 of the ramp rollers being mutually parallel with the axes 63 of the link rollers. Each of the ramp rollers 64 has an outer diametral surface which defines a ramp surface engageable by one of the link rollers 62 in rolling motion therealong.

A workpiece 45 which is engaged between the dies 48 and 50 may be crimped by moving the wedge 4 along axis 58 between the link rollers 62 such that the link rollers roll on opposite sides of the wedge and are urged into rolling engagement with the ramp rollers 64, thus driving the link rollers 62 upwardly and moving the slide member 40 and the die 50 toward the die 48. The wedge axis 58 and the die axis 54 need not be coincident as shown in the drawings, but need only be parallel. As fully described in U.S. Pat. No. 5,309,751 which is incorporated by reference as if set forth fully herein, the wedge 4, the link rollers 62 and the ramp rollers 64 advantageously cooperate to provide a mechanical advantage which varies over different portions of the crimping stroke.

Figure 6:
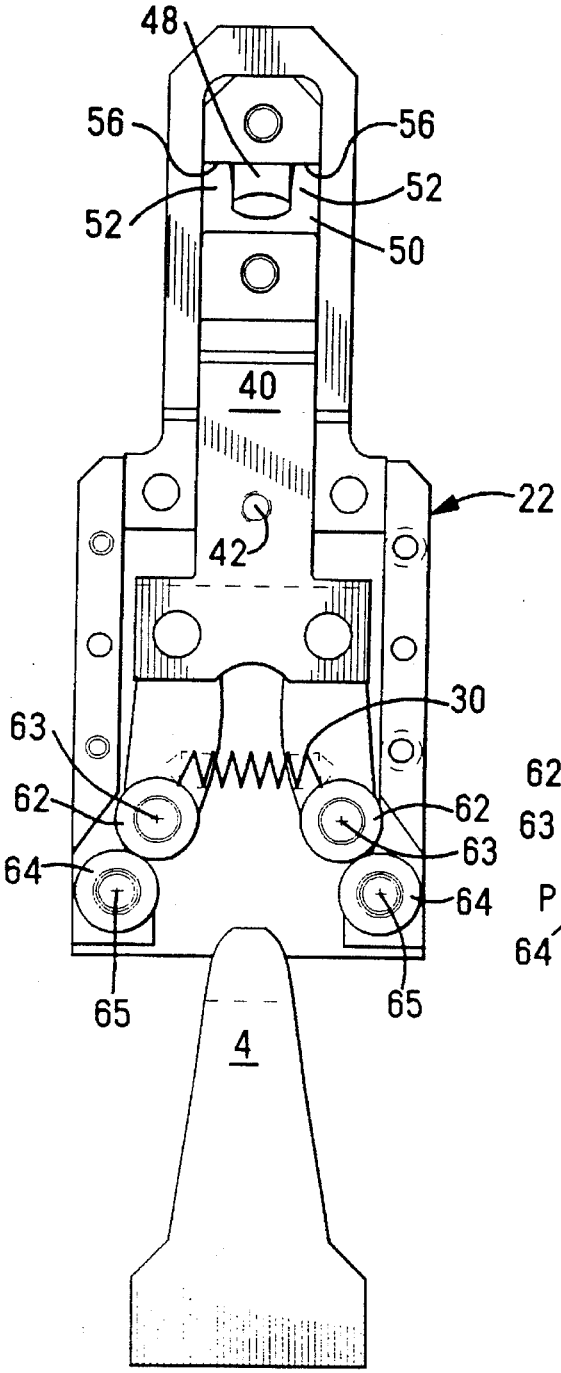
FIG. 6 is a cross-sectional view of the crimping head in an alternate embodiment.

The present invention further includes a spring 30 having opposite ends disposed in opposed bores in the links 60. The spring 30 provides a resilient means for biasing apart the links 60 with a relatively small force, for example, about one pound, so as to maintain the link rollers 62 in engagement with the ramp rollers 64 during periods when the wedge 4 is in a retracted position away from the link rollers 62. As shown in FIG. 6, when there is no workpiece between the dies and the wedge is in the retracted position, the biasing of the spring 30 keeps the link rollers 62 near the tops of the ramp rollers 64, thereby biasing the slide member 40 and the die 50 toward the die 48. Projections 52 of the die 50 abut shoulders 56 of the die 48 when the dies are fully closed.

Figure 2:
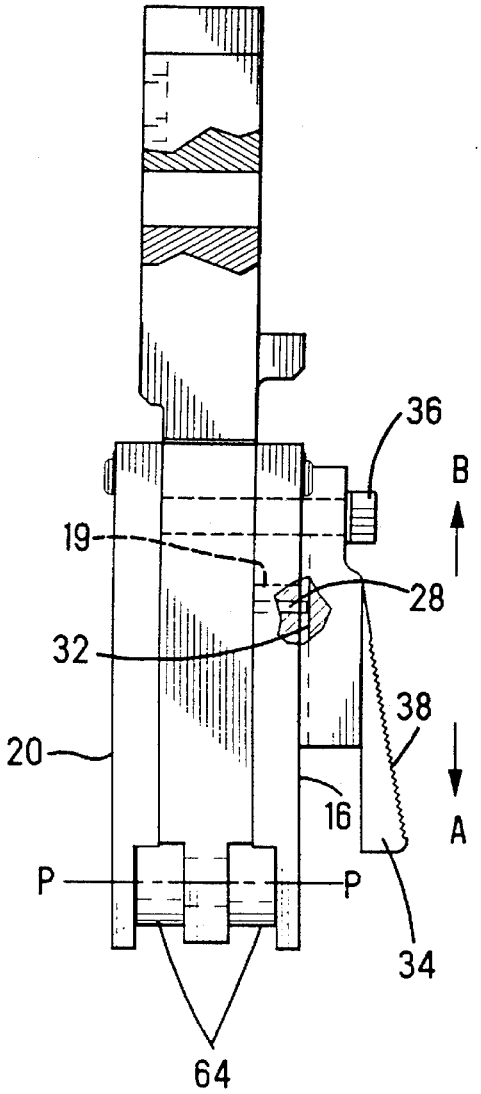
FIG. 2 is side view of a crimping head for the tool according to the invention.
Figure 3:
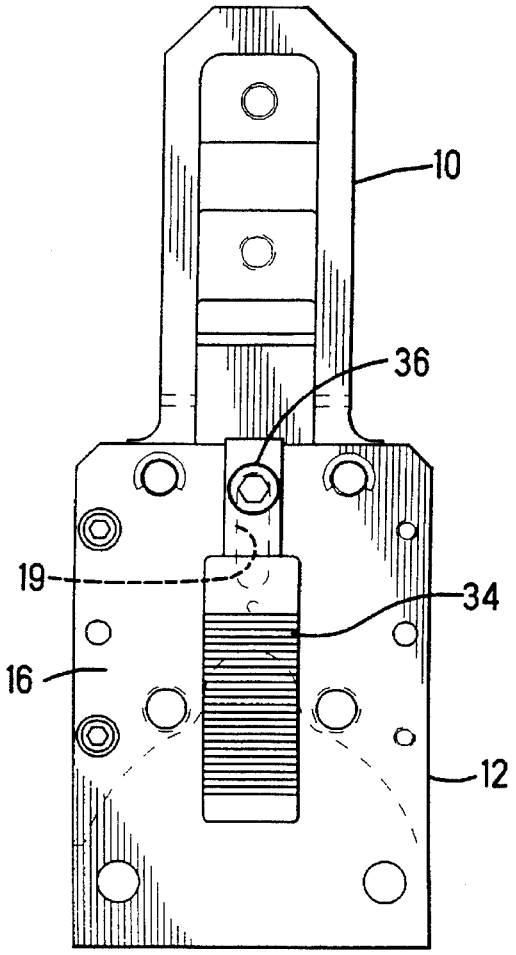
FIG. 3 is a front view of the crimping head.

In order to insert a workpiece in the tool, the slide member 40 must be retracted to separate the dies. A shift lever 34, shown in FIGS. 1, 2 and 3, provides a means for retracting the slide member 40 against the biasing of the spring 30. The shift lever 34 is attached to the slide member 40 by a fastener 36 which extends through a clearance hole in the shift lever, through an elongated slot 19 in the frame, and is engaged in a threaded hole 42, shown in FIG. 4, in the slide member. The shift lever 34 is stabilized by a spring pin 28 which is fixed in the front housing 16 and has one end received in a groove 32 extending longitudinally along the back of the shift lever, thereby resisting pivoting of the shift lever on the fastener 36. The shift lever 34 has a serrated surface 38 which increases grip to enable manual operation, and preferably thumb actuation. A tool operator can open the dies while holding the tool in one hand by moving the shift lever 34 with one's thumb in the direction of arrow A shown in FIG. 2, thereby moving the slide member 40 in the same direction so as to retract the die 50 away from the die 48.

Figure 7:
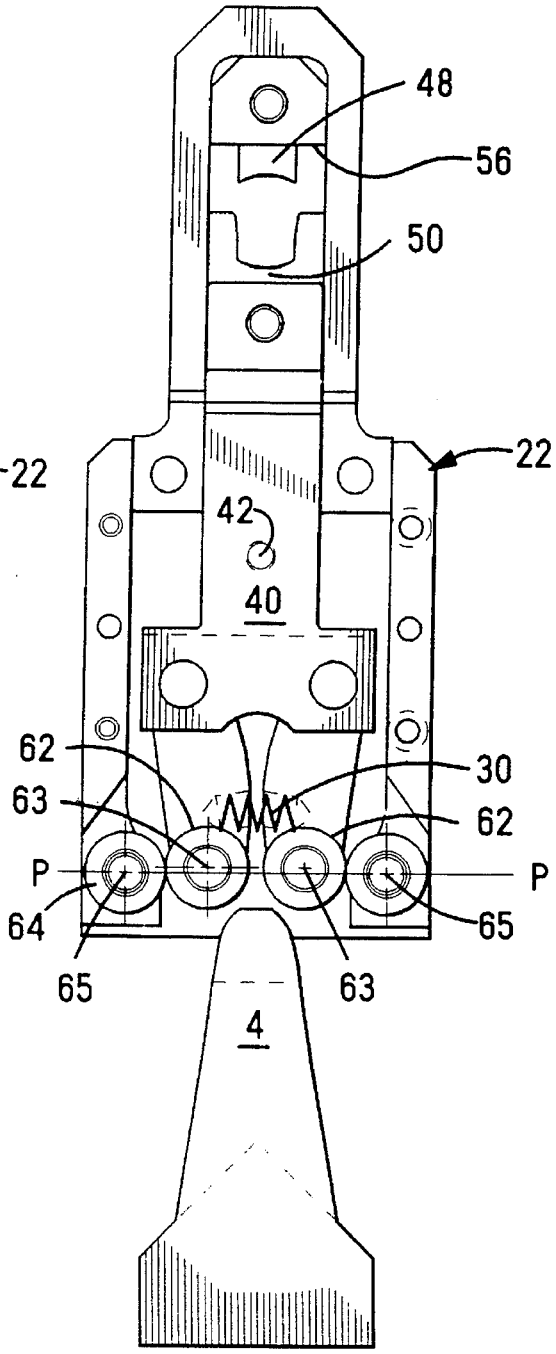
FIG. 7 is a cross-sectional view of the crimping head with the dies biased in a closed position.

Referring to FIG. 7, retraction of the slide member 40 causes the link rollers 62 to roll along the ramp rollers 64. As long as the axes 63 of the link rollers are above plane P—P defined by the axes 65 of the ramp rollers, the operator must maintain a force on the shift lever 34 to counteract the biasing force of the spring 30 and hold the dies open. While holding the dies open with one hand, the operator may insert a workpiece between the dies with the other hand. The operator then releases the shift lever 34 to capture the workpiece between the dies 48 and 50 due to the biasing of the spring 30, as shown in FIG. 4.

Figure 8:
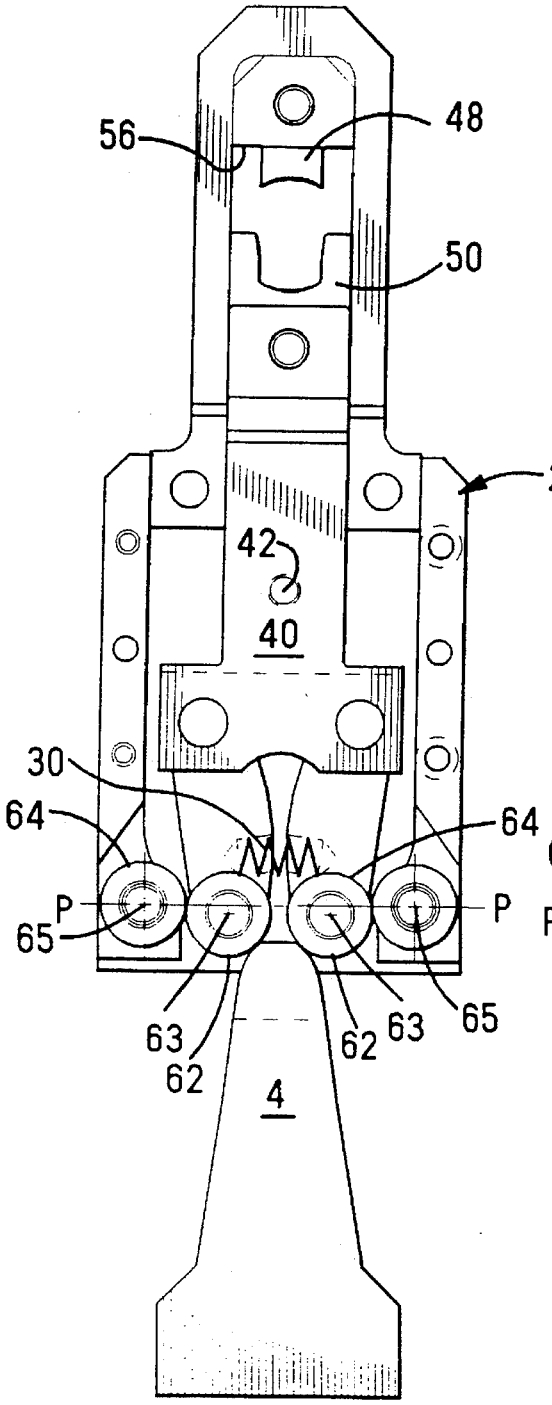
FIG. 8 is a cross-sectional view of the crimping head with the dies biased in an open position.

The dies may be biased to an open position by moving the shift lever 34 sufficiently far to bring the axes 63 of the link rollers below the plane P—P, as shown in FIG. 8. When the axes 63 are moved below the plane P—P, the biasing of the spring 30 urges the link rollers 62 further downwardly along the curved lower surfaces of the ramp rollers 64. Thus, the shift lever 34 in conjunction with the spring 30, the link rollers 62 and the ramp rollers 64 provides a means for selectively biasing the die 50 either toward or away from the die 48.

It is critical that the link rollers 62 not be permitted to traverse very far below the plane P—P; otherwise, actuation of the wedge 4 would jam the link rollers 62 beneath the ramp rollers 64. Therefore, the tool is arranged so that the axes 63 are limited to nominal movement below the plane P—P of approximately 0.030 inch. This is accomplished by appropriate selection of the length and location of the slot 19 which limits downward movement of the shift lever 34 when the fastener 36, which is carried by the shift lever 34, engages the lower surface of the slot 19 shown in FIG. 2. The lower surface of the slot 19 thus provides a stop which limits retraction of the slide member 40.

When the link rollers 62 are in the biased open position shown in FIG. 8, a crimping operation can be initiated by actuation of the wedge 4 which will urge the rollers above the plane P—P and urge the dies closed as the rollers roll on opposite sides of the wedge in the usual manner. Alternatively, the rollers 62 can be released from the biased open position by slight upward pressure on the shift lever 34 in the direction of arrow B, FIG. 2, thereby moving the axes 63 above the plane P—P, at which point the spring 30 will continue to urge the rollers upwardly to the closed position shown in FIG. 4. The wedge 4 is then actuated to complete the crimping operation.

Figure 9:
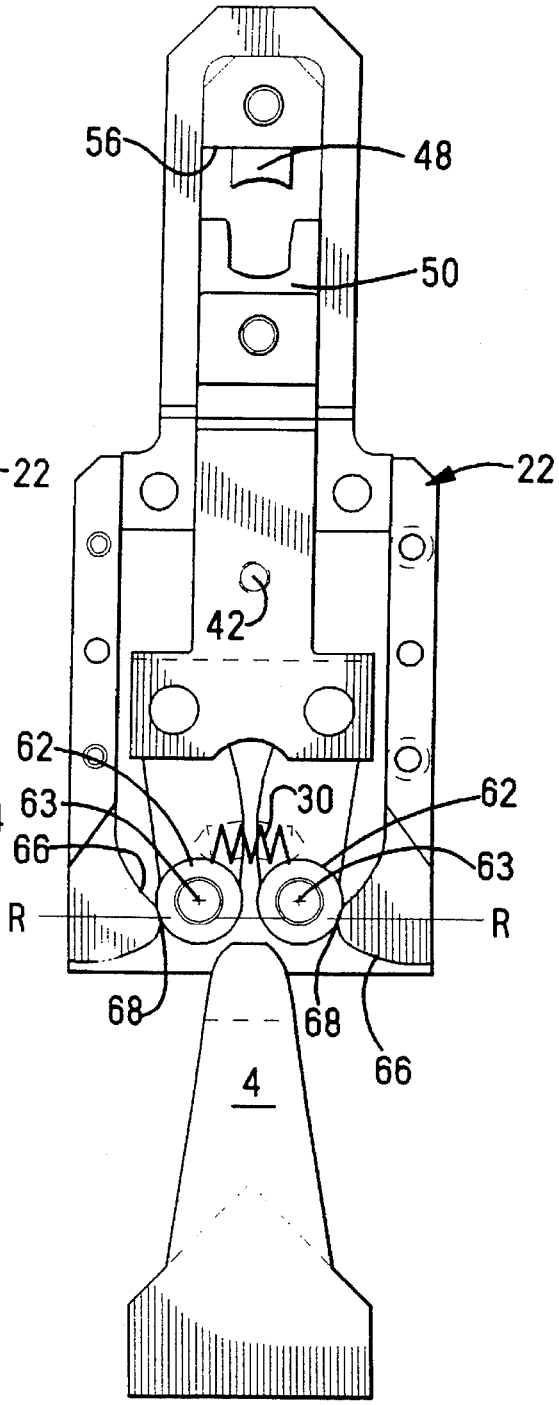

In an alternate embodiment, the ramps which are engageable by the link rollers may be inclined or arcuate surfaces which are formed integral with the frame. As shown in FIG. 9, wherein like elements as in the previous embodiment are referred to by the same reference numerals, the frame 22 is formed with integral arcuate surfaces 66 which define the ramps. Vertices 68 are defined at points of minimum separation between the surfaces 66. A plane R—R extending through the vertices 68 is perpendicular to the wedge axis 58. The plane R—R is a demarcation, similar to the plane P—P in the prior example, between opposed portions of the arcuate surfaces 66 above and below the plane R—R which have a greater separation than the minimum separation between the vertices 68. Thus, the dies 48 and 50 are biased open when the axes 63 of the link rollers 62 are moved below the plane R—R.

The invention provides a powered crimping tool wherein the dies can be selectively biased to either an open or a closed position during intervals between crimping, and the biasing can be manually relieved for brief time periods. The invention enables a tool operator to readily extract a crimped product from between the dies and to insert a new workpiece while holding the tool in one hand. Further, a crimpable terminal can be lightly captured between the dies prior to crimping, thereby making it easier for an operator to hold a terminal and conductor in proper relative position before they are crimped.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A tool for crimping a workpiece, comprising:

a frame;

a mating pair of crimping dies, one of which is attached to said frame, the other of which is attached to a slide member coupled to said frame and arranged to reciprocate for effecting movement of said other die along a die axis toward and away from said one die;

a pair of links each having one end pivotally attached to said slide member;

a pair of link rollers each journaled for rotation at an end of a respective one of said links opposite to said pivotal attachment thereof, said link rollers having mutually parallel axes of rotation;

a pair of ramps attached to said frame on respective opposite sides of said link rollers and arranged for rolling engagement by respective ones of said link rollers;

an actuator attached to said frame and operable to move a wedge between said link rollers along a wedge axis parallel to said die axis, said wedge being arranged to engage said link rollers during movement of said wedge in one direction such that said link rollers roll on opposite sides of said wedge and are urged into rolling engagement with said ramps, thereby moving said slide member such that said other die is moved toward said one die for effecting said crimping;

resilient means for biasing apart said links with a relatively small force such that said link rollers are urged into rolling engagement with respective ones of said ramps when said wedge is in a disengaged position from said link rollers; and, means for retracting said slide member such that said other die is selectively movable away from said one die when said wedge is in said disengaged position, wherein said other die is separable from said one die against the biasing force of the resilient means to permit said workpiece to be introduced between said dies, and upon release of said means for selectively retracting, said resilient means urges said other die toward said one die to secure said workpiece therebetween.

2. The crimping tool according to claim 1, wherein said ramps define respective arcuate surfaces, and said rolling engagement occurs along said arcuate surfaces.

3. The crimping tool according to claim 1, wherein said ramps are defined by respective ramp rollers each journaled for rotation in said frame, and said ramp rollers have axes of rotation which are mutually parallel with said axes of rotation of said link rollers.

4. The crimping tool according to claim 3, wherein said axes of rotation of said ramp rollers define a plane, said wedge urges said link rollers into rolling engagement with said ramp rollers when said axes of rotation of said link rollers are on one side of said plane, and said means for retracting is operable to retract said slide member until said axes of said link rollers pass through said plane to an opposite side thereof, wherein said other die is maintained at a distance from said one die by said resilient means which urges said link rollers into engagement with said ramp rollers when said axes of said link rollers are disposed on said opposite side of said plane.

5. The crimping tool according to claim 4, further comprising a stop member disposed to limit retraction of said slide member such that said axes of said link rollers are movable only nominally beyond said plane on said opposite side thereof.

6. The crimping tool according to claim 5, wherein said means for retracting is a shift lever which is coupled to said slide member by a fastener extending through a slot in said frame, and said stop member is defined by a surface of said slot which is engageable by said fastener.

7. A tool for crimping a workpiece, comprising:

a frame;

a mating pair of crimping dies, one of which is attached to said frame, the other of which is attached to a slide member coupled to said frame and arranged to reciprocate for effecting movement of said other die along a die axis toward and away from said one die;

a pair of links each having one end pivotally attached to said slide member;

a pair of link rollers each journaled for rotation at an end of a respective one of said links opposite to said pivotal attachment thereof, said link rollers having mutually parallel axes of rotation;

a pair of ramps attached to said frame on respective opposite sides of said link rollers and arranged for rolling engagement by respective ones of said link rollers;

an actuator attached to said frame and operable to move a wedge between said link rollers along a wedge axis parallel to said die axis, said wedge being arranged to engage said link rollers during movement of said wedge in one direction such that said link rollers roll on opposite sides of said wedge and are urged into rolling engagement with said ramps, thereby moving said slide member such that said other die is moved toward said one die for effecting said crimping; and, means for selectively biasing said other die either toward or away from said one die with a relatively small force when said wedge is disengaged from said link rollers.

8. The crimping tool according to claim 7, wherein said means for selectively biasing comprises:

said ramps having respective surfaces in opposed relationship with a varying separation therebetween, a minimum separation between said ramps defining a plane which is perpendicular to said wedge axis, each of said ramps extending on both sides of said plane with a greater separation than said minimum therebetween;

resilient means for biasing apart said links with a relatively small force such that said link rollers are urged into rolling engagement with respective ones of said ramps when said wedge is in a disengaged position from said link rollers; and, means for retracting said slide member such that said other die is selectively movable away from said one die when said wedge is in said disengaged position, said means for retracting being operable to move said axes of said link rollers through said plane to an opposite side thereof, wherein said other die is biased toward said one die when said axes of said link rollers are disposed on one side of said plane, and said other die is biased away from said one die when said axes of said link rollers are disposed on said opposite side of said plane.

9. The crimping tool according to claim 8, wherein said ramps are defined by respective ramp rollers each journaled for rotation in said frame, and said ramp rollers have axes of rotation which are mutually parallel with said axes of rotation of said link rollers.

10. The crimping tool according to claim 9, further comprising a stop member disposed to limit retraction of said slide member such that said axes of said link rollers are movable only nominally beyond said plane on said opposite side thereof.

11. The crimping tool according to claim 10, wherein said means for retracting is a shift lever which is coupled to said slide member by a fastener extending through a slot in said frame, and said stop member is defined by a surface of said slot which is engageable by said fastener.

* * * * *